US008919673B2

(12) United States Patent
Subramanian et al.

(10) Patent No.: US 8,919,673 B2
(45) Date of Patent: Dec. 30, 2014

(54) APPARATUS AND METHOD FOR A FUEL NOZZLE

(75) Inventors: Karthik Subramanian, Greenville, SC (US); Bryan Wesley Romig, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 678 days.

(21) Appl. No.: 12/759,765

(22) Filed: Apr. 14, 2010

(65) Prior Publication Data

US 2011/0252803 A1 Oct. 20, 2011

(51) Int. Cl.

| | |
|---|---|
| ***F02M 61/10*** | (2006.01) |
| ***B05B 7/10*** | (2006.01) |
| ***F02C 1/00*** | (2006.01) |
| ***F02G 3/00*** | (2006.01) |
| ***F23R 3/28*** | (2006.01) |

(52) U.S. Cl.

CPC ..... *F23R 3/28* (2013.01)

USPC ..... 239/533.11; 239/406; 60/737; 60/742

(58) Field of Classification Search

CPC ..... F02M 61/12; F02M 61/16; F02M 61/10; F02M 61/168; F02M 51/6071; F23R 3/286; F23R 3/36; F23R 3/14; F23R 3/343; F23D 17/002

USPC ..... 239/533.11, 398, 417, 403, 405, 406, 239/400, 404; 60/733, 737, 732, 738, 748, 60/740, 742

See application file for complete search history.

(56) References Cited

U.S. PATENT DOCUMENTS

| | | | | | |
|---|---|---|---|---|---|
| 2,411,181 | A | * | 11/1946 | Altorfer | 239/424 |
| 2,443,707 | A | * | 6/1948 | Korsgren | 126/116 R |
| 2,657,531 | A | * | 11/1953 | Pierce | 60/755 |
| 3,648,457 | A | * | 3/1972 | Bobo | 60/737 |
| 3,703,259 | A | * | 11/1972 | Sturgess et al. | 239/400 |
| 4,100,733 | A | * | 7/1978 | Striebel et al. | 60/39.463 |
| 4,246,757 | A | * | 1/1981 | Heberling | 60/737 |
| 4,426,841 | A | * | 1/1984 | Cornelius et al. | 60/39.23 |

(Continued)

FOREIGN PATENT DOCUMENTS

| | | | |
|---|---|---|---|
| CN | 101563533 | A | 10/2009 |
| CN | 102116479 | A | 7/2011 |
| EP | 2151627 | A2 | 2/2010 |
| WO | 8904439 | A1 | 5/1989 |

OTHER PUBLICATIONS

Unofficial English translation of Chinese Office Action and Search Report issued from CN Application No. 201110101939.3 on Aug. 5, 2014.

*Primary Examiner* — Justin Jonaitis
*Assistant Examiner* — Chee-Chong Lee
(74) *Attorney, Agent, or Firm* — Dority & Manning, PA

(57) ABSTRACT

A fuel nozzle includes a fuel plenum, an outer body surrounding the fuel plenum, and bore holes that extend longitudinally through the outer body. The fuel nozzle also includes means for fixedly attaching the fuel plenum to the outer body and passages that provide fluid communication between the fuel plenum and the bore holes. A method for manufacturing a fuel nozzle includes drilling bore holes longitudinally through an outer body and drilling passages in the outer body to the bore holes. The method further includes inserting a fuel plenum into the outer body, wherein the passages provide a fluid communication between the bore holes and the fuel plenum, and attaching the fuel plenum to the outer body.

14 Claims, 3 Drawing Sheets

(56) References Cited

U.S. PATENT DOCUMENTS

| | | | | |
|---|---|---|---|---|
| 4,982,570 | A | 1/1991 | Waslo et al. | |
| 5,101,633 | A | 4/1992 | Keller et al. | |
| 5,131,840 | A | 7/1992 | Zettner | |
| 5,259,184 | A | 11/1993 | Borkowicz et al. | |
| 6,098,407 | A * | 8/2000 | Korzendorfer et al. | 60/737 |
| 6,446,439 | B1 | 9/2002 | Kraft et al. | |
| 7,024,861 | B2 | 4/2006 | Martling | |
| 7,568,345 | B2 * | 8/2009 | Furletov et al. | 60/742 |
| 7,908,864 | B2 | 3/2011 | Haynes et al. | |
| 8,181,891 | B2 * | 5/2012 | Ziminsky et al. | 60/737 |
| 8,276,385 | B2 * | 10/2012 | Zuo et al. | 60/737 |
| 8,677,760 | B2 | 3/2014 | Khan et al. | |
| 2008/0083229 | A1 * | 4/2008 | Haynes et al. | 60/776 |
| 2009/0223054 | A1 * | 9/2009 | Nyberg et al. | 29/890.142 |
| 2010/0031662 | A1 * | 2/2010 | Zuo | 60/740 |

* cited by examiner

APPARATUS AND METHOD FOR A FUEL NOZZLE

FIELD OF THE INVENTION

The present invention relates generally to a fuel nozzle in a combustor and a method for making such a fuel nozzle.

BACKGROUND OF THE INVENTION

Combustors are widely used in commercial operations. For example, a typical gas turbine includes at least one combustor that injects fuel into the flow of a compressed working fluid and ignites the mixture to produce combustion gases having a high temperature and pressure. The combustion gases exit the combustor and flow to a turbine where they expand to produce work.

FIG. 1 provides a simplified cross-section of a combustor 10 known in the art. A casing 12 surrounds the combustor 10 to contain the compressed working fluid. Nozzles are arranged in an end cover 16, for example, with primary nozzles 18 radially arranged around a secondary nozzle 20, as shown in FIG. 1. A liner 22 downstream of the nozzles 18, 20 defines an upstream chamber 24 and a downstream chamber 26 separated by a throat 28. The compressed working fluid flows between the casing 12 and the liner 22 to the nozzles 18, 20. The nozzles 18, 20 mix fuel with the compressed working fluid, and the mixture flows from the nozzles 18, 20 into the upstream 24 and downstream 26 chambers where combustion occurs.

During full speed base load operations, the flow rate of the fuel and compressed working fluid mixture through the nozzles 18, 20 is sufficiently high so that combustion occurs only in the downstream chamber 26. During reduced power operations, however, the primary nozzles 18 operate in a diffusion mode in which the flow rate of the fuel and compressed working fluid mixture from the primary nozzles 18 is reduced so that combustion of the fuel and the compressed working fluid mixture from the primary nozzles 18 occurs in the upstream chamber 24. During all operations, the secondary nozzle 20 operates as a combined diffusion and premix nozzle that provides the flame source for the operation of the combustor. In this manner, fuel flow through the primary and secondary nozzles 18, 20 can be adjusted, depending on the operational load of the combustor, to optimize nitrous oxide NOx emissions throughout the entire operating range of the combustor.

Various efforts have been made to design and manufacture fuel nozzles with improved premixing and diffusion capabilities, especially for higher reactivity fuels. For example, direct metal laser sintering, braising, and casting are manufacturing techniques previously used to fabricate fuel nozzles that premix the fuel and compressed working fluid prior to combustion. However, these manufacturing techniques are relatively expensive, time-consuming, and otherwise less than optimum for large-scale production. Therefore, an improved fuel nozzle that can pre-mix the fuel and compressed working fluid prior to combustion would be desirable. In addition, an improved method for making such a nozzle that utilizes less expensive machining techniques rather than other more costly techniques would be desirable.

BRIEF DESCRIPTION OF THE INVENTION

Aspects and advantages of the invention are set forth below in the following description, or may be obvious from the description, or may be learned through practice of the invention.

One embodiment of the present invention is a fuel nozzle that includes a fuel plenum and an outer body surrounding the fuel plenum. The outer body includes a plurality of bore holes that extend longitudinally through the outer body. The fuel nozzle further includes means for fixedly attaching the fuel plenum to the outer body and a plurality of passages in the outer body between at least some of the plurality of bore holes and the fuel plenum, wherein the plurality of passages provide fluid communication between the fuel plenum and at least some of the plurality of bore holes.

Another embodiment of the present invention is a fuel nozzle that includes an outer body, wherein the outer body includes a plurality of bore holes that extend longitudinally through the outer body. A fuel plenum is inserted into the outer body, and a connection is between the outer body and the fuel plenum, wherein the outer body is fixed to and removable from the fuel plenum. A plurality of passages is in the outer body between at least some of the plurality of bore holes and the fuel plenum, wherein the plurality of passages provide fluid communication between the fuel plenum and at least some of the plurality of bore holes.

A still further embodiment of the present invention is a method for manufacturing a fuel nozzle. The method includes drilling a plurality of bore holes longitudinally through an outer body and drilling a plurality of passages in the outer body to at least some of the plurality of bore holes. The method further includes inserting a fuel plenum into the outer body, wherein the plurality of passages in the outer body provide a fluid communication between at least some of the plurality of bore holes and the fuel plenum, and attaching the fuel plenum to the outer body.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
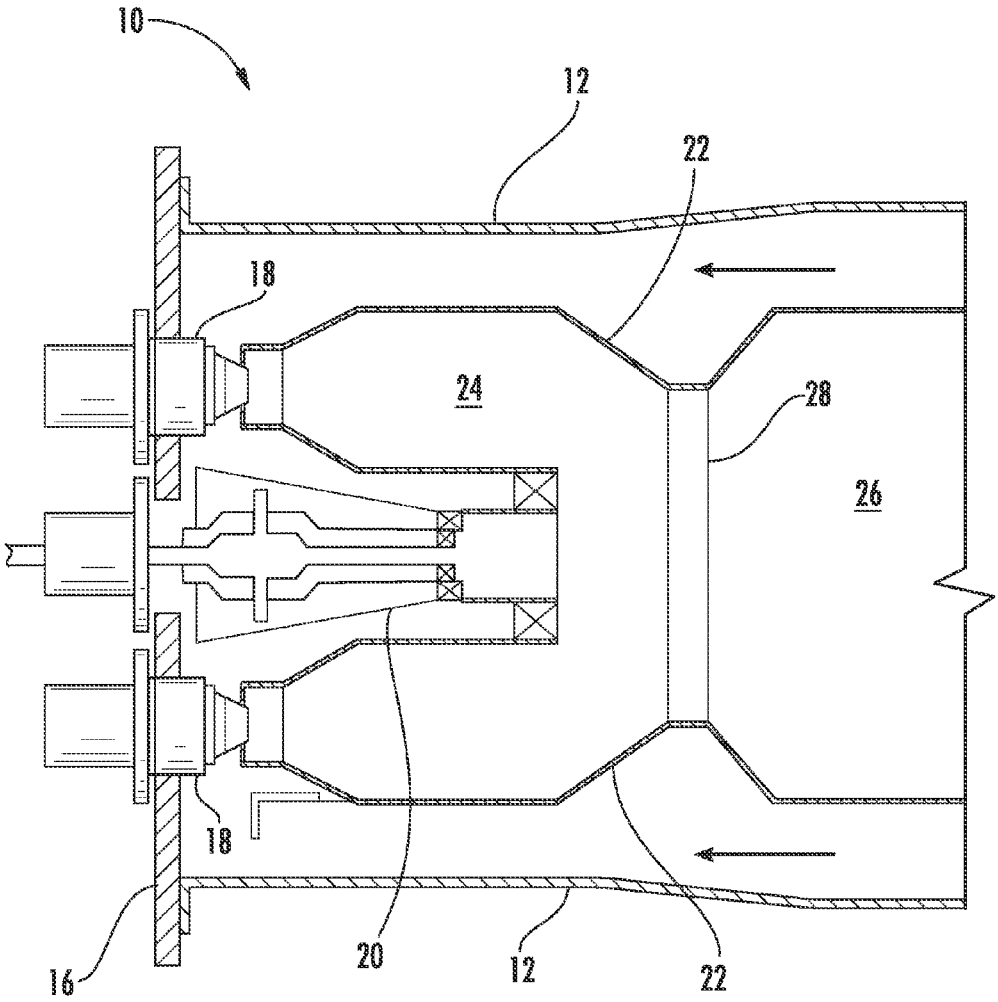
FIGURE 1 (PRIOR ART)
FIG. 1 shows a simplified cross-section of a combustor known in the art.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention may be machined and assembled to create a premixed direct injection (PDI) fuel nozzle design. In general, the fuel nozzle design comprises two components which may be separately machined or fabricated for subsequent assembly. One piece may be referred to as the tip or outer body, and the other piece may be referred to as the fuel cartridge or fuel plenum. The fuel plenum directs fuel downstream against a front wall of the outer body to provide impingement cooling to the front wall. After impinging against the front wall, the fuel then flows through passages to bore holes in the outer body where the fuel mixes with a fluid flowing through the bore holes before exiting the fuel nozzle and flowing into the combustion chamber. The fuel plenum and outer body, with their various bore holes and other passages, may be readily manufactured by machining instead of requiring more costly processes such as direct metal laser sintering. As a result, fuel nozzles according to various embodiments of the present invention may be less expensive to manufacture, while still providing improved cooling to the fuel nozzle and premixing the fuel prior to combustion.

Figure 2:
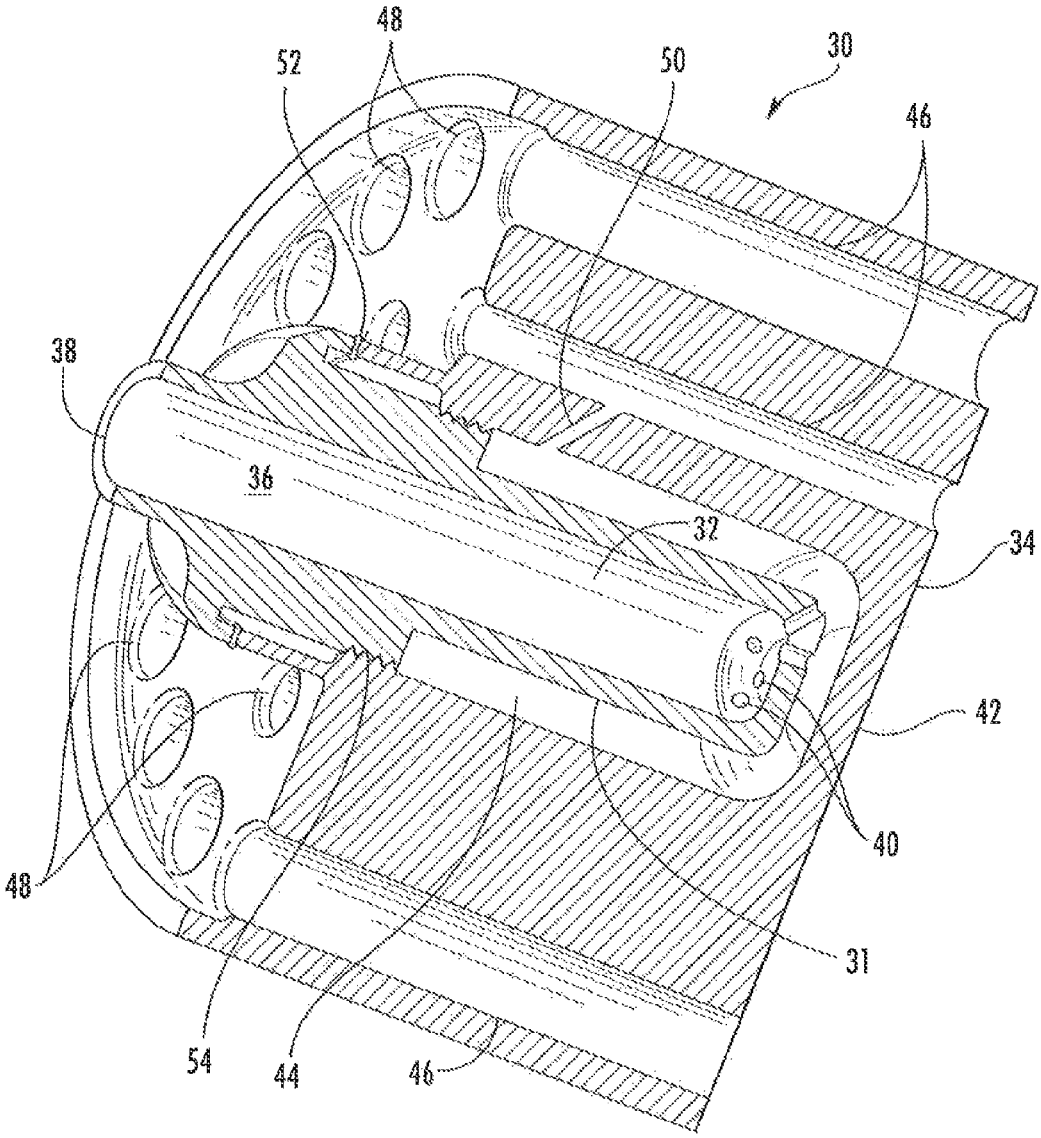
FIG. 2 shows a cross-section of a perspective view of a fuel nozzle according to one embodiment of the present invention.

FIG. 2 shows a cross-section of a perspective view of a fuel nozzle 30 according to one embodiment of the present invention. As will be explained, the fuel nozzle 30 generally includes two modular components, namely a fuel cartridge 31 that defines a or fuel plenum 32 and an outer body 34, which may be separately machined or fabricated for subsequent assembly. The fuel cartridge 31 provides a chamber or conduit for fuel flow to and through the fuel nozzle 30. For example, the fuel cartridge 31 may comprise a longitudinal passage 36 centrally located in the fuel nozzle 30, as shown in FIG. 2. An inlet 38 to the fuel cartridge 31 may be connected to a fuel supply (not shown). Possible fuels supplied to and used by commercial combustion engines include, for example, blast furnace gas, coke oven gas, natural gas, vaporized liquefied natural gas (LNG), propane, and hydrogen. The fuel cartridge 31 may further include a plurality of apertures 40. The apertures 40 may be located, for example, at the downstream portion of the fuel cartridge 31, as shown in FIG. 2. The plurality of apertures 40 allow the fuel to flow through the fuel cartridge 31 and out of the fuel plenum 32.

The outer body 34 includes a front wall 42 downstream of the fuel cartridge 31 and proximate to the plurality of apertures 40 in the fuel cartridge 31. The front wall 42 is generally the closest portion of the fuel nozzle 30 to the combustion flame and therefore is subjected to higher temperatures than the remainder of the fuel nozzle 30. Fuel flowing through the plurality of apertures 40 exits the fuel plenum 32 and impinges on the front wall 42 to provide impingement cooling to the front wall 42.

The outer body 34 generally surrounds the fuel cartridge 31, creating a space or annular plenum 44 between the fuel cartridge 31 and the outer body 34. The outer body 34 further includes a plurality of bore holes 46 that extend longitudinally through the outer body 34. The bore holes 46 may be arranged in any desired pattern. For example, as shown in FIG. 2, the bore holes 46 may be arranged in substantially concentric circles around the fuel cartridge 31. The bore holes 46 are generally cylindrical in shape, although the present invention is not limited to any particular shape of bore holes 46, unless specifically recited in the claims. Each bore hole 46 generally includes an inlet 48, which may be beveled, as shown in FIG. 2, to facilitate an even distribution of fluid flow into and through the bore holes 46.

The outer body 34 further includes a plurality of passages 50 between at least some of the bore holes 46 and the fuel cartridge 31. The plurality of passages 50 provide fluid communication between the annular plenum 44 and at least some of the plurality of bore holes 46. Specifically, fuel exiting the fuel cartridge 31 through the plurality of apertures 40 impinges on the front wall 42 to provide impingement cooling to the front wall 42. The fuel then flows through the annular plenum 44 until it reaches one of the plurality of passages 50 where it flows into the associated bore hole 46. In this manner, the fuel mixes with the fluid (e.g., compressed working fluid from a compressor) flowing through the bore hole 46 before exiting the bore hole 46 and entering the combustion chamber.

The fuel cartridge 31 and outer body 34 may be separately machined and manufactured for subsequent assembly. For example, the fuel cartridge 31 and/or outer body 34 may be cast from a molten metal. The various bore holes 46 and passages 50 in the outer body 34 may then be drilled to accurately and inexpensively position, size, and orient the various elements in the outer body 34. If desired, the inlet 48 to various bore holes 46 may be further machined to include a beveled surface or otherwise increase the surface area of the inlet 48 for specific boreholes 46, depending on particular design considerations. The fuel cartridge 31 may then be inserted into the annular plenum 44 defined by the outer body 34 and attached to the outer body 34, Various methods and means are known in the art for attaching or connecting the fuel cartridge 31 to the outer body 34. For example, brazing, welding, complementary threads, seal rings, and other equivalent techniques and connections are known in the art for attaching or connecting the fuel cartridge 31 to the outer body 34. Depending on the particular design needs, the connection between the fuel cartridge 31 and the outer body 34 may be permanent or temporary to allow for removal of the fuel cartridge 31 during maintenance or repair. The particular embodiment shown in FIG. 2 includes a continuous weld bead 52 between the fuel plenum 32 and the outer body 34. In addition, this particular embodiment also includes a threaded connection 54 between the fuel cartridge 31 and the outer body 34. Alternate embodiments within the scope of the present invention may include only one of these means for attaching or connecting the fuel cartridge 31 to the outer body 34, and/or other welding techniques, such as tack welding, and/or other mechanical fittings or connections between the fuel cartridge 31 and the outer body 34.

Figure 3:
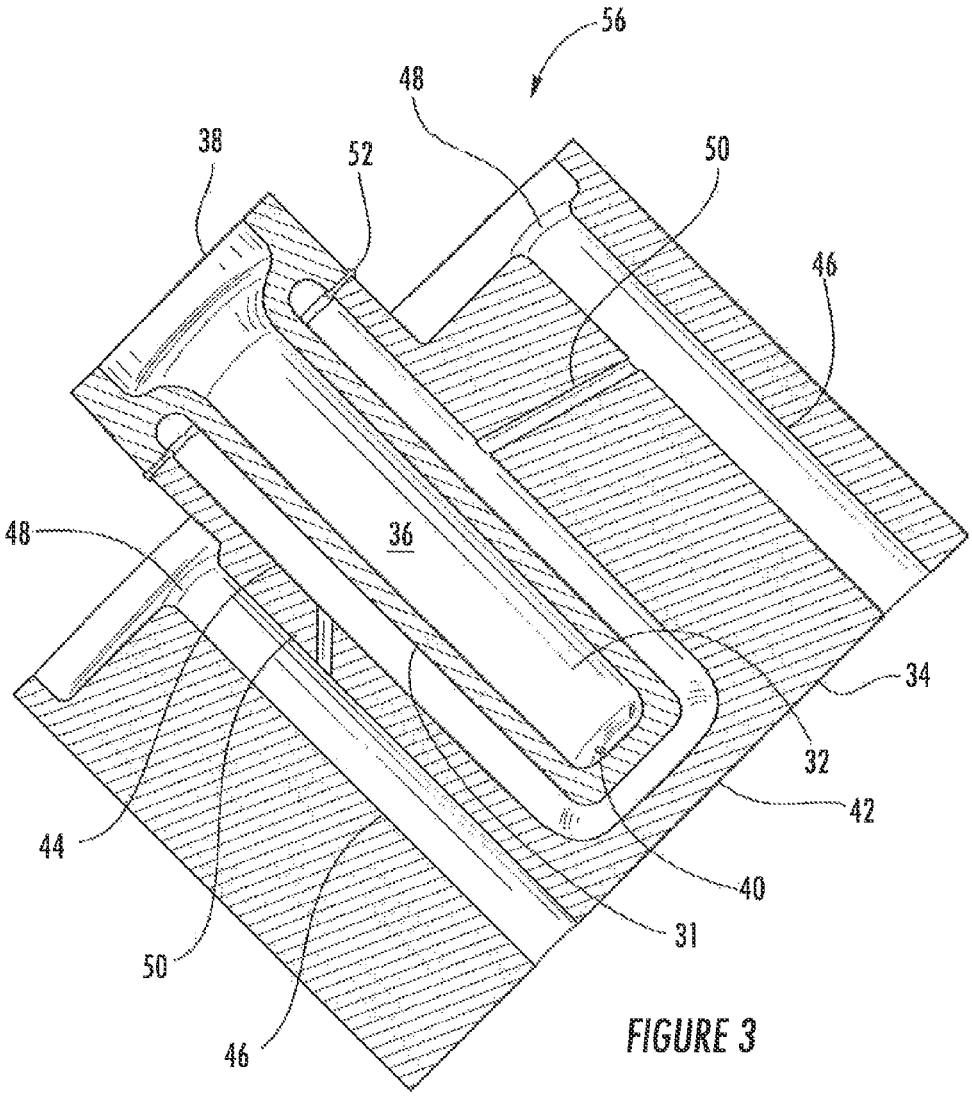
FIG. 3 shows a cross-section of a fuel nozzle according to an alternate embodiment of the present invention.

FIG. 3 shows a cross-section of a fuel nozzle 56 according to an alternate embodiment of the present invention. The fuel cartridge 31 and outer body 34 in this embodiment are substantially similar to the embodiment previously described and illustrated in FIG. 2, and the same reference numbers are therefore used. In this particular embodiment, the means for attaching or connecting the fuel cartridge 31 to the outer body 34 again includes a continuous weld bead 52 around the perimeter of the fuel plenum 32. In addition, the cross-section of this particular embodiment illustrates the plurality of passages 50 between bore holes 46 located at different distances from the fuel cartridge 31. In this manner, the fuel may be more evenly distributed and mixed in specifically selected bore holes 46.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel nozzle, comprising:

a. an outer body, the outer body defining a plurality of bore holes extending longitudinally through the outer body, each bore hole having an inlet and an outlet, wherein the outlet provides for fluid flow though a front wall of the outer body;

b. an annular plenum partially defined by the outer body and circumferentially surrounded by the plurality of bore holes, wherein the annular plenum is partially defined by an inner surface of the front wall;

c. a plurality of passages providing fluid communication between the annular plenum and at least some of the plurality of bore holes; and d. a fuel cartridge extending longitudinally within and partially defining the annular plenum, the fuel cartridge having a downstream end that terminates within the annular plenum upstream from the inner surface of the front wall so as to form a gap between the inner surface of the front wall and the downstream end of the fuel cartridge, the fuel cartridge defining a fuel plenum within the annular plenum, the fuel cartridge further defining a plurality of apertures disposed upstream from the inner surface of the front wall, the plurality of apertures providing for fluid communication between the fuel plenum and the annular plenum, wherein the apertures are arranged so as to impinge a fuel from the fuel plenum onto the inner surface of the front wall, wherein the plurality of apertures are upstream from the plurality of passages.

2. The fuel nozzle as in claim 1, wherein the plurality of bore holes are arranged in substantially concentric circles around the annular plenum.

3. The fuel nozzle as in claim 1, wherein the front wall extends perpendicular to the fuel cartridge.

4. The fuel nozzle as in claim 1, wherein each of the plurality of bore holes includes a beveled inlet.

5. The fuel nozzle as in claim 1, wherein the fuel cartridge is connected to the outer body via a continuous weld between the fuel cartridge and the outer body.

6. The fuel nozzle as in claim 1, wherein the fuel cartridge is connected to the outer body via a threaded engagement.

7. A fuel nozzle, comprising:

a. an outer body, the outer body defining a plurality of bore holes that extend longitudinally through the outer body, each bore hole having an inlet and an outlet, wherein the outlet provides for fluid flow though a front wall, the outer body further defining an annular plenum that extends longitudinally and coaxially within the outer body;

b. a fuel cartridge inserted into the annular plenum, the fuel cartridge partially defining the annular plenum, the fuel cartridge further defining a fuel plenum and a plurality of apertures, the plurality of apertures being disposed upstream from an inner surface of the front wall and providing for fluid communication between the fuel plenum and the annular plenum, wherein the apertures are arranged to impinge a fuel from the fuel plenum against the inner surface of the front wall;

c. a connection between the outer body and the fuel cartridge, wherein the outer body is fixed to and removable from the fuel cartridge; and d. a plurality of passage defined by the outer body downstream from the plurality of apertures, wherein the plurality of passages provides for fluid communication between the annular plenum and at least one of the plurality of bore holes.

8. The fuel nozzle as in claim 7, wherein the plurality of bore holes is arranged in substantially concentric circles around the fuel plenum.

9. The fuel nozzle as in claim 7, wherein the front wall at least partially defines the annular plenum.

10. The fuel nozzle as in claim 9, wherein the plurality of apertures is defined proximate to the front wall.

11. The fuel nozzle as in claim 7, wherein the fuel cartridge defines an inner diameter of the annular plenum.

12. The fuel nozzle as in claim 7, wherein each of the plurality of bore holes includes a beveled inlet.

13. The fuel nozzle as in claim 7, wherein the connection between the outer body and the fuel cartridge includes a continuous weld between the outer body and the fuel plenum.

14. The fuel nozzle as in claim 7, wherein the connection between the outer body' and the fuel cartridge includes complementary threads on the outer body and fuel cartridge.

* * * * *